US008208672B2

(12) United States Patent
Nageno et al.

(10) Patent No.: US 8,208,672 B2
(45) Date of Patent: Jun. 26, 2012

(54) HEADPHONE

(75) Inventors: Koji Nageno, Tokyo (JP); Yuusuke Oosato, Tokyo (JP)

(73) Assignee: Sony Corporation (JP)

( * ) Notice: Subject to any disclaimer, the term of this patent is extended or adjusted under 35 U.S.C. 154(b) by 967 days.

(21) Appl. No.: 12/074,304

(22) Filed: Mar. 3, 2008

(65) Prior Publication Data

US 2008/0219492 A1 Sep. 11, 2008

(30) Foreign Application Priority Data

Mar. 9, 2007 (JP) ..... P2007-060831

(51) Int. Cl.
*H04R 25/00* (2006.01)

(52) U.S. Cl. ..... 381/374; 381/370; 381/381

(58) Field of Classification Search ..... 381/309, 381/327, 330, 370, 374, 376, 378, 379, 381, 381/382, 383, 384; 379/430; 181/128, 129, 181/130, 135

See application file for complete search history.

(56) References Cited

U.S. PATENT DOCUMENTS

| | | | | |
|---|---|---|---|---|
| 6,104,824 | A | 8/2000 | Ito | |
| 6,105,714 | A | 8/2000 | Lindgren | |
| 6,233,345 | B1 * | 5/2001 | Urwyler | 381/381 |
| 6,868,164 | B2 * | 3/2005 | Ito et al. | 381/370 |

FOREIGN PATENT DOCUMENTS

| | | | |
|---|---|---|---|
| JP | 57181182 | A | 11/1982 |
| JP | 10-257581 | A | 9/1998 |
| JP | 11275675 | A | 10/1999 |
| JP | 2001506874 | A | 5/2001 |
| JP | 2002176689 | A | 6/2002 |
| JP | 2003134587 | A | 5/2003 |
| JP | 2005064909 | A | 3/2005 |
| JP | 2007013873 | A | 1/2007 |

OTHER PUBLICATIONS

Office Action from Japanese Application No. 2007-060831, dated Jul. 12, 2011.

* cited by examiner

*Primary Examiner* — Huyen D Le

(74) *Attorney, Agent, or Firm* — Lerner, David, Littenberg, Krumholz & Mentlik, LLP

(57) ABSTRACT

A headphone including a housing that includes a speaker unit and that has a generally flat surface that comes into contact with an outward facing surface of an auricle of an ear and a neckband that is connected to the housing. The neckband has a ring form with a partially cut-out section and the inner side of at least one end of the neckband is connected to the housing. The neckband and the generally flat surface of the housing are generally coplanar, and have an elastic force in a direction that causes the neckband and the generally flat surface of the housing to return to the coplanar arrangement.

11 Claims, 9 Drawing Sheets

HEADPHONE

CROSS-REFERENCE TO RELATED APPLICATION(S)

The present application claims priority from Japanese Patent Application No. JP 2007-060831 filed in the Japanese Patent Office on Mar. 9, 2007, the entire content of which is incorporated herein by reference.

BACKGROUND OF THE INVENTION

1. Field of the Invention

The invention relates to a headphone.

2. Description of the Related Art

Headphones include housings with built-in speaker units that output a playback sound, and a band that is connected to the housings.

Housings, depending on their size and their position in relation to an auricle 10 of the human ear, are classified into circumaural housings, supra-aural housings, intra-concha housings, insert housings and so on. With reference to the general view of the auricle 10 shown in FIG. 10, circumaural housings are formed to cover the whole of the auricle 10, while supra-aural housings are smaller than circumaural housings, and are shaped to form contact with the outward facing surface of the auricle 10. Intra-concha housings are inserted into a cavity of the concha 12 of the auricle 10, and are held in place with a tragus 14 or an antitragus 16. Insert housings are inserted into an external auditory canal 18, and have a form that allows them to be held in place in the same way as an earplug.

In particular, in order to ensure the housings are well balanced in circumaural and supra-aural headphones, the housings are held in place by, for example, a belt-shaped band that is connected to the housings. The band of a neckband is passed around the occipital region of the head, and the band of a headband is passed over the parietal region of the head.

A known headphone with a supra-aural housing that is connected to a neckband, is disclosed, for example, in Japanese Patent Application Publication No. JP-A-10-257581.

SUMMARY OF THE INVENTION

It is to be noted that headbands and neckbands used for headphones take a three dimensional form to limit deformation and to follow the shape of the head. For that reason, at the point of sale, headphones are contained in packaging, and after purchase, the user stores the headphone in a bag or the like. As a result, the overall size of the headphone becomes large and the headphone takes up space. For example, as the band has a form to follow the shape of the head, it has a height of 50 mm or more.

The transportation and storage of products at the point of sale therefore requires a lot of space, and there is inconvenience in carrying the product after purchase.

Also, where the band is manufactured using a die assembly, in order to manufacture the band in a form to follow the shape of the head, it is necessary to manufacture a die with a complex shape, leading to difficulties with die manufacture and die design.

The present invention addresses the above-identified problems and provides a new and improved headphone that is compact in size and does not take up space when not being worn, and allows the shape of the neckband to be simplified.

According to an embodiment of the present invention, there is provided a headphone including a housing that includes a speaker unit and that has a generally flat surface that comes into contact with an outward facing surface of an auricle of an ear, and a neckband that is connected to the housing. The neckband has a ring form with a partially cut-out section and the inner side of both ends is connected to the housing. The neckband and the generally flat surface of the housing are generally arranged in a coplanar manner, and have an elastic force in a direction that causes the neckband and the generally flat surface of the housing to return to the coplanar arrangement.

According to the present structure, the housing comes into contact with the auricle of the ear, and a playback sound is output. The neckband can support the housing. If no external pressure is applied to the neckband, it is generally coplanar with the generally flat surface of the housing. If external pressure is applied to the neckband, an energizing force acts to return the neckband to the coplanar arrangement.

Both ends of the neckband are formed in a bow shape, and the curvature of both ends can be smaller than the curvature of the other sections of the neckband. According to the present structure, both the ends of the neckband are connected to the housing, so the sections of the neckband with the small curvature are arranged around the auricle of the ear.

The neckband may be formed of an elastic material. According to the present structure, a neckband can be formed that has elastic force.

When the headphone is worn on the head, the housing can rotate due to flexure of the neckband. According to the present structure, the housing can be pressed onto the side of the auricle of the ear.

The above-described rotation of the housing may be centered around an axis lying in a vertical direction in relation to the head. According to the present structure, the housing can be arranged along the temporal region of the head.

The above-described rotation of the housing may be centered around an axis lying in an anteroposterior direction in relation to the head. According to the present structure, the housing can be arranged along the temporal region of the head.

Coupling members may be established at the ends of the neckband to connect both the ends of the neckband. According to the present structure, when external pressure is not applied to the neckband, the generally coplanar arrangement of the neckband and the generally flat surface of the housing can be secured in a reliable manner.

A cable may be connected to an inner side of the neckband that is in proximity to the temporal region of the head, the cable transmitting a playback signal that is transmitted from a replay device. According to the present structure, when the neckband is worn, interference with the wearer's head by the cable is minimized.

The housing may include a receiving portion that wirelessly receives the playback signal transmitted from the replay device. According to the present structure, when the neckband is worn, there is no interference between the cable that transmits the playback signal transmitted from the replay device and the wearer's head.

A cross section of the neckband may be one of a generally circular form and a flat plane form. According to the present structure, a neckband can be formed that has variations in form.

Furthermore, according to another embodiment of the present invention, there is a provided a headphone including a housing that includes a speaker unit and that has a generally flat surface that comes into contact with an outward facing surface of an auricle of an ear, and a neckband that is connected to the housing. The neckband has a ring form with a partially cut-out section and the inner side of both ends is connected to the housing. When the headphone is not worn, the neckband is generally coplanar with the generally flat surface of the housing. When the headphone is worn, both ends of the neckband are arranged around an auricle of an ear, and a section excluding both the ends having a larger curvature than both the ends is arranged around an occipital region of a head. The neckband and the housing have an elastic force in a direction that causes the neckband and the housing to return to the generally coplanar arrangement.

According to the present structure, the housing can come into contact with the auricle of the ear, a playback sound be output, and the housing be held in place by the neckband. When there is no external pressure applied to the neckband, when it is not being worn, the neckband is generally coplanar with the generally flat surface of the housing. When it is worn, an energizing force works to return the neckband to the generally coplanar arrangement.

When worn on the head, the housing can rotate due to flexure of the neckband. According to the present structure, the housing can be pressed onto the side of the auricle of the ear.

According to the embodiments of the present invention described above, the headphone has a compact size that does not take up space and the shape of the neckband can be simplified.

BRIEF DESCRIPTION OF THE DRAWING(S)

DETAILED DESCRIPTION OF THE PREFERRED EMBODIMENT(S)

Figure 1:
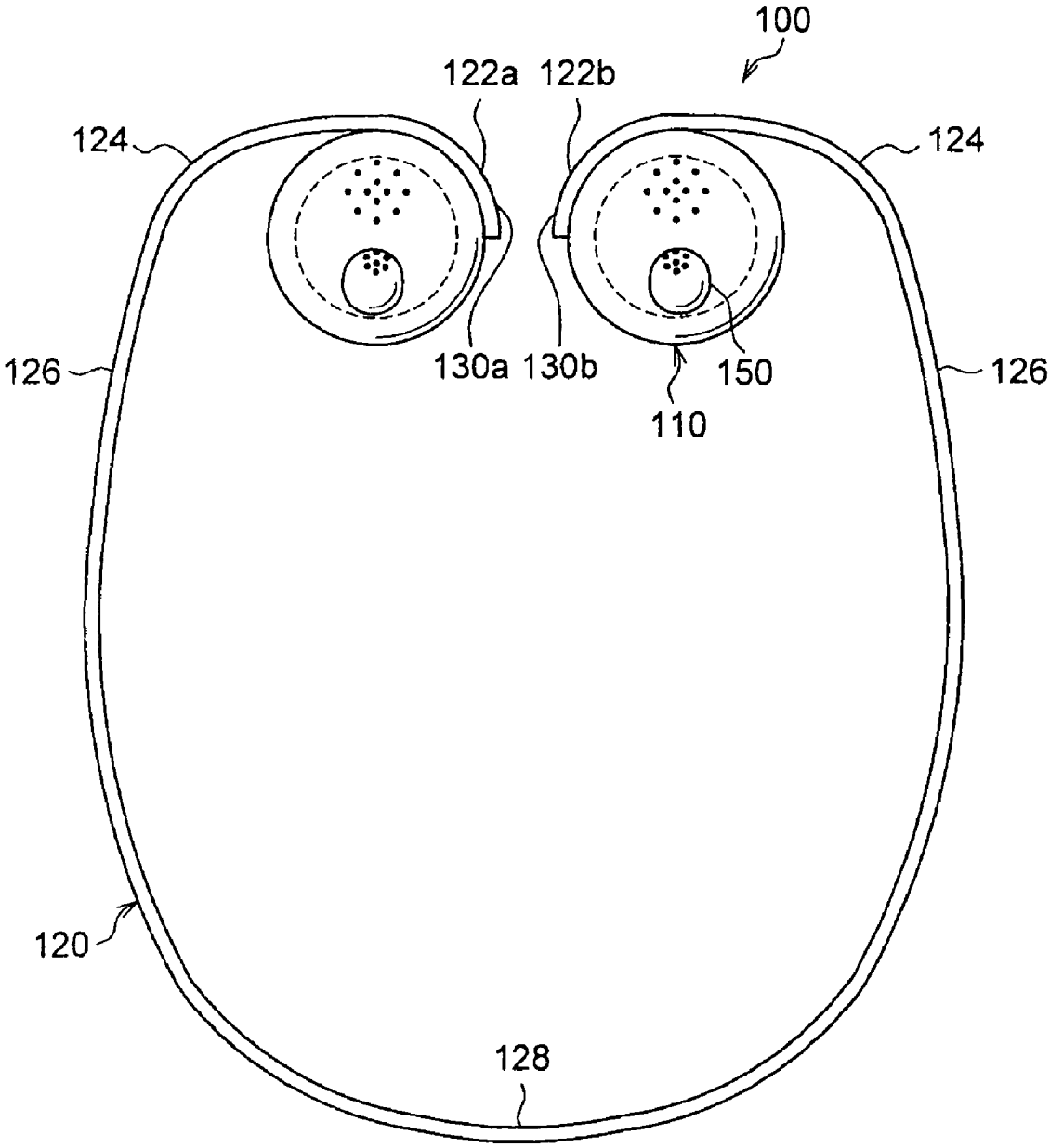
FIG. 1 is a plan view showing a headphone 100 according to a first embodiment of the present invention.

Hereinafter, preferred embodiments of the present invention will be described in detail with reference to the appended drawings. Note that, in this specification and the appended drawings, structural elements that have substantially the same function and structure are denoted with the same reference numerals, and repeated explanation of these structural elements is omitted.

First Embodiment

Figure 2:
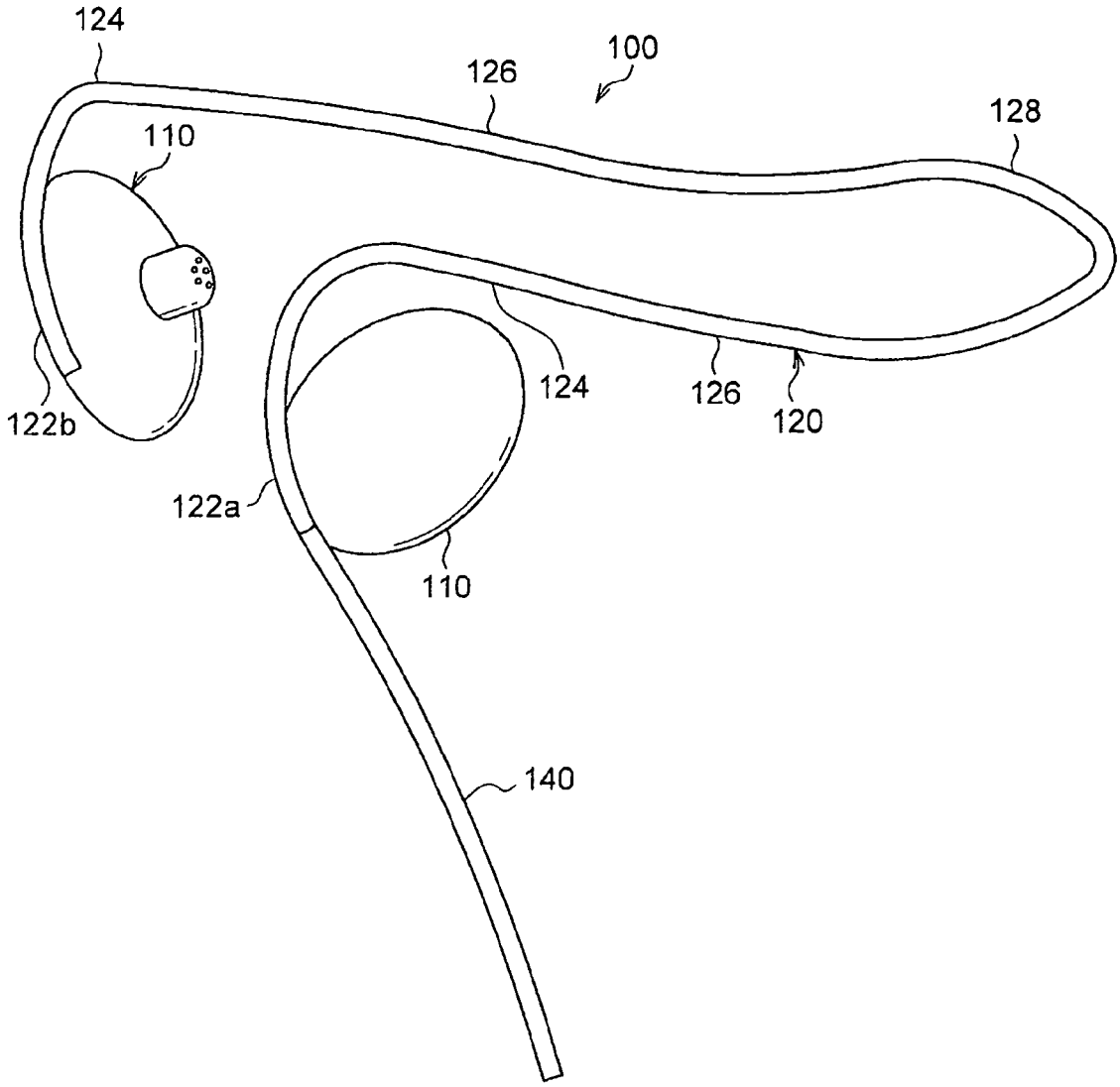
FIG. 2 is a perspective figure showing the headphone 100 according to the first embodiment.

First, a headphone 100 according to a first embodiment of the present invention will be explained. FIG. 1 is a plan view showing the headphone 100 according to the first embodiment. FIG. 2 is a perspective view showing the headphone 100 according to the first embodiment.

The headphone 100, as shown in FIG. 1 and FIG. 2, includes a pair of housings 110 with built in speaker units 116 (shown in FIG. 4) that output a playback sound, and a neckband 120 that is connected to the housings 110.

Figure 3:
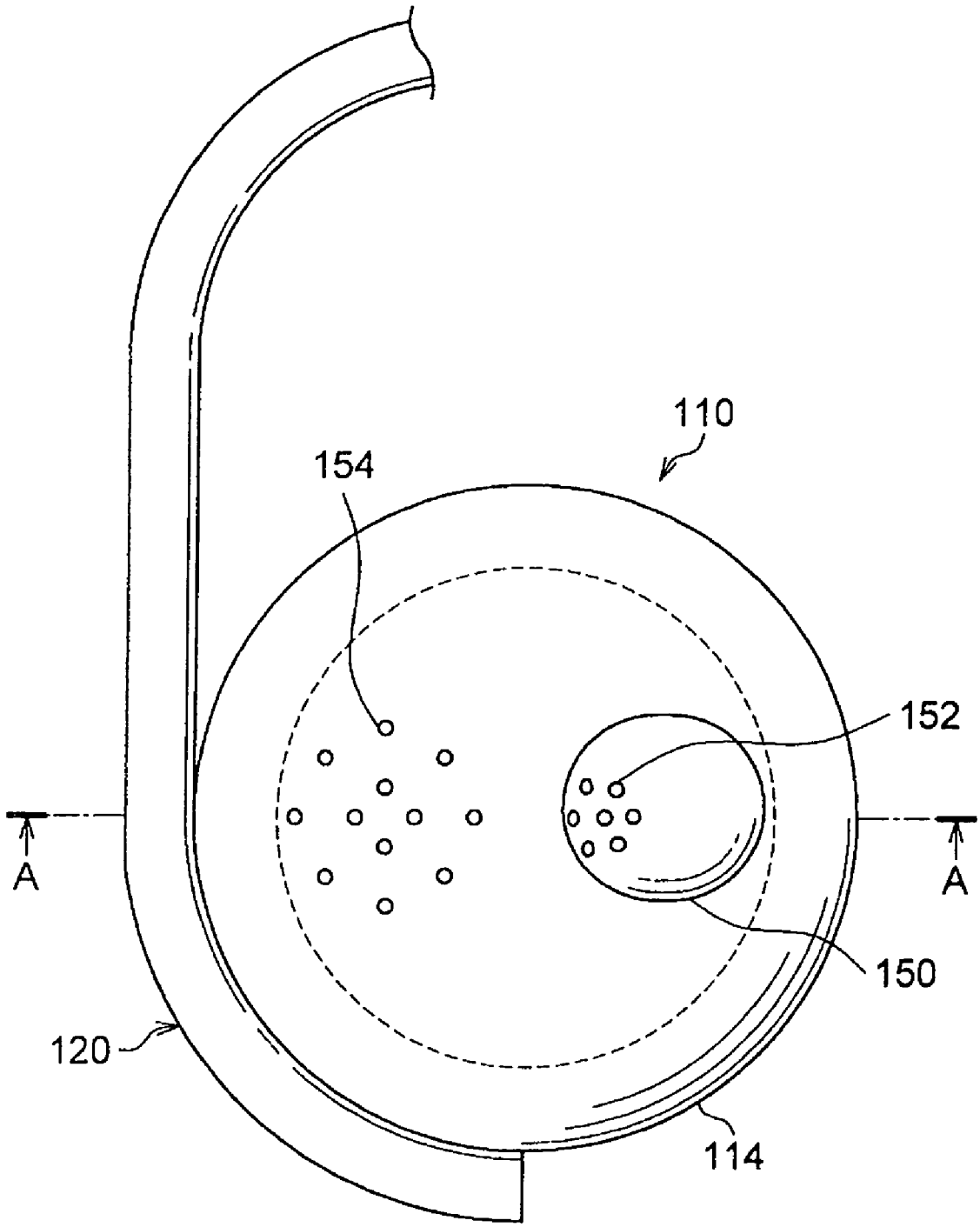
FIG. 3 is a plan view showing a housing 110 according to the first embodiment.
Figure 4:
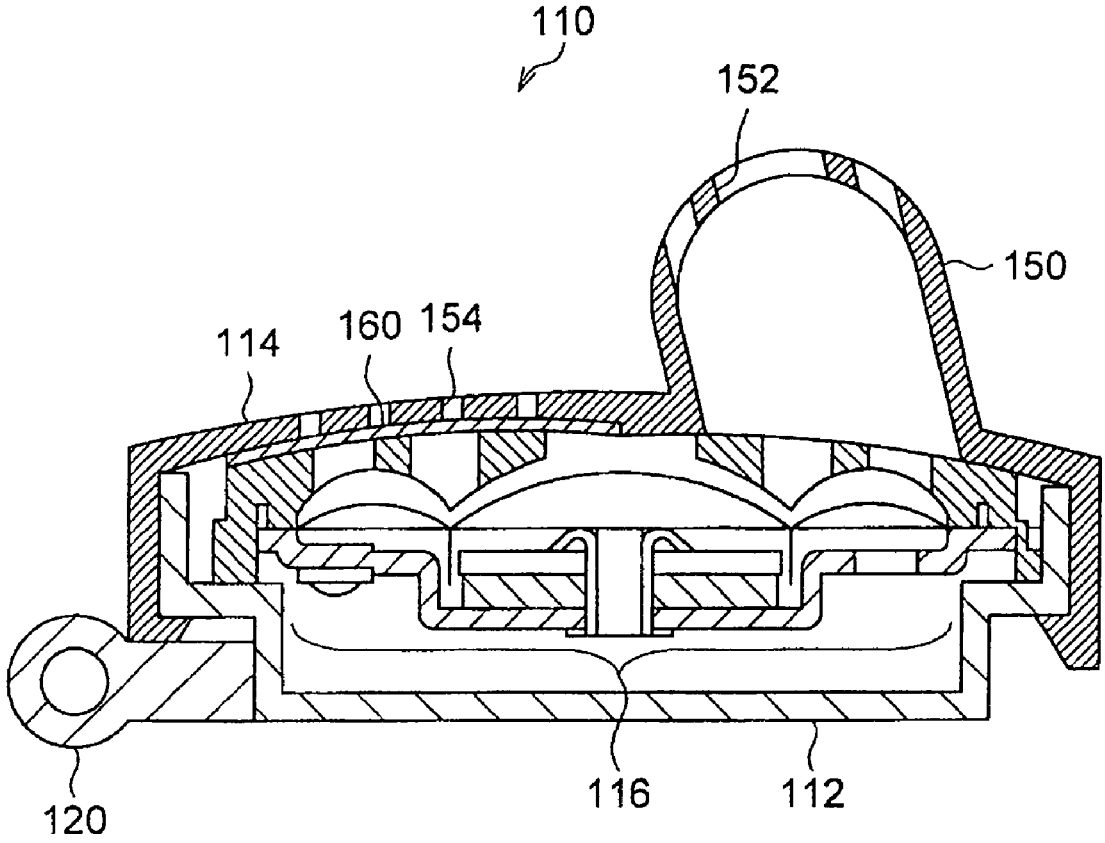
FIG. 4 is a cross sectional view of the housing 110 according to the first embodiment along the line A-A of FIG. 3.

First, the housing 110 according to the first embodiment will be explained with reference to FIG. 1 to FIG. 4. (Although the device includes two housings 110, one for each ear, the following explanation will mainly focus on one of the housings 110 for the sake of explanatory simplicity). FIG. 3 is a plan view showing the housing 110 according to the first embodiment. FIG. 4 is a cross sectional view of the housing 110 according to the first embodiment along the line A-A of FIG. 3.

Figure 10:
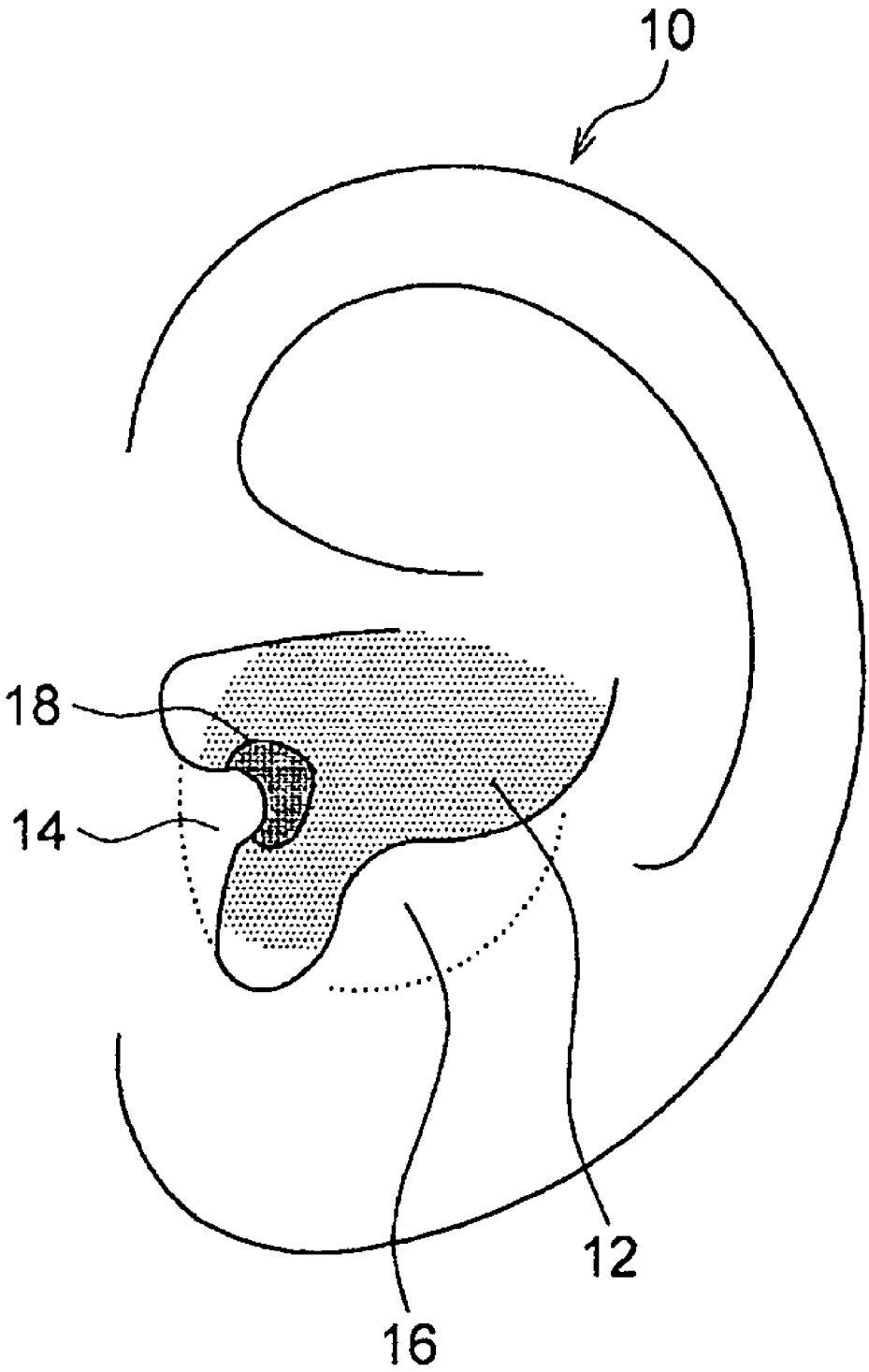
FIG. 10 is a front view showing a human auricle 10.

The housing 110, as shown in FIG. 3 and FIG. 4, is a case with a circular surface, and includes a body portion 112, a cover member 114, a speaker unit 116 and an acoustic resistant member 160. The headphone 100 according to the present embodiment is a supra-aural headphone that is positioned to come into contact with the outward facing surface of an auricle 10 (see FIG. 10). The housing 110 has a circular shape with a diameter of approximately 30 mm to 50 mm.

The body portion 112 contains the speaker unit 116 and is covered by the cover member 114. The side surface of the body portion 112 is connected to the neckband 120, and the neckband 120 positions the housing 110 on the head in a stable manner. When the headphone 100 is worn, the body portion 112 is positioned on the opposite side from the surface that comes into contact with the side of the auricle 10.

The body portion 112 includes a conducting wire 140. The conducting wire 140 is connected to a replay device (not shown in the figures) and connected to the speaker unit 116, and inputs a playback signal. Here, the speaker unit 116 and the replay device are described as being connected by a cable, but the invention is not limited to this example, and the speaker unit 116 may wirelessly receive the playback signal. In this case, the body portion 112 may include a receiving portion (not shown in the figures), a battery portion (not shown in the figures) and the like.

The cover member 114 covers the body portion 112, and a protruding portion 150, for example, may also be formed. When the headphone 100 is worn, the section of the cover member 114 excluding the protruding portion 150 comes into contact with the peripheral area of a cavity of a concha 12 of the auricle 10, and has, for example a smooth and soft curved surface. Also, aperture holes 154 may also be formed in the section of the cover member 114 excluding the protruding portion 150. The aperture holes 154 link the interior and the exterior of the housing 110 so that they communicate with each other.

The protruding portion 150 is formed as a protruding shape in a specified area of one surface of the cover member 114. The protruding portion 150, as shown in FIG. 1 to FIG. 4, for example, protrudes in a cylindrical shape from one surface of the cover member 114, and is a hollow member with a curved leading edge. The protruding portion 150, for example, is formed with a diameter of 5 mm to 20 mm. When positioned on the head, the protruding portion 150 is inserted into the cavity of the concha 12.

The protruding portion 150, as shown in FIG. 3 and FIG. 4, may protrude at a slanting angle, and the angle of the slant can be any selected angle. By adjusting the angle of the slant, the protruding portion 150 can be inserted adequately into the cavity of the concha 12 and can hold the housing 110 in position on the head.

The protruding portion 150 may be formed of an elastic material that has elasticity, or may be formed of a hard material that does not have elasticity. If an elastic material is used, the headphone 100 feels more flexible when worn, and the housing 110 can be held in place in the cavity of the concha 12 by the elasticity. Aperture holes 152 may be formed in the leading edge of the protruding portion 150. The playback sound output by the speaker unit 116 can be generated through the aperture holes 152.

The speaker unit 116 is housed in the body portion 112, inputs the playback signal from the replay device and outputs the playback sound. A general use speaker unit can be used as the speaker unit 116. A detailed explanation is omitted here.

The acoustic resistant member 160 is formed, for example, as a flat plate, and is formed, for example, from a non-woven fabric or urethane foam. By using the acoustic resistant member 160 to raise or lower the air-flow resistance, the resonance, product characteristics and the peculiarities and so on of the body portion 112 and the speaker unit 116 and the like can be corrected, and the sound quality of the playback sound can be adjusted.

The acoustic resistant member 160 is provided between the cover member 114 and the speaker unit 116. The acoustic material 160 may, for example, be provided in sections excepting the section corresponding to the protruding portion 150, or may be provided across all the interior sections of the cover member 114 including the section corresponding to the protruding portion 150, and the surface area can be changed according to the adjustment of the sound quality of the playback sound and the like.

Figure 5:
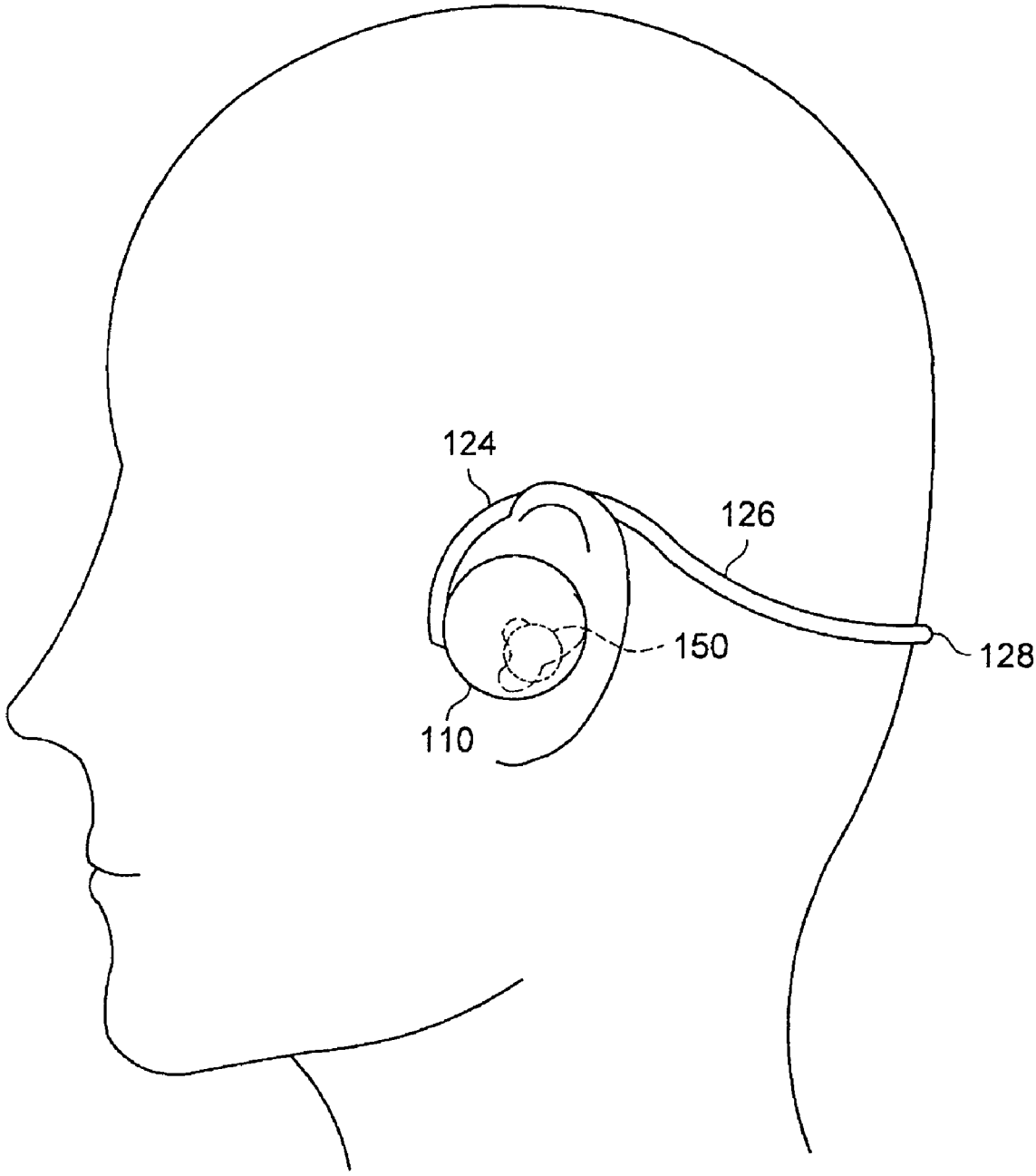
FIG. 5 is a side view showing the headphone 100 according to the first embodiment when worn on a head.
Figure 6:
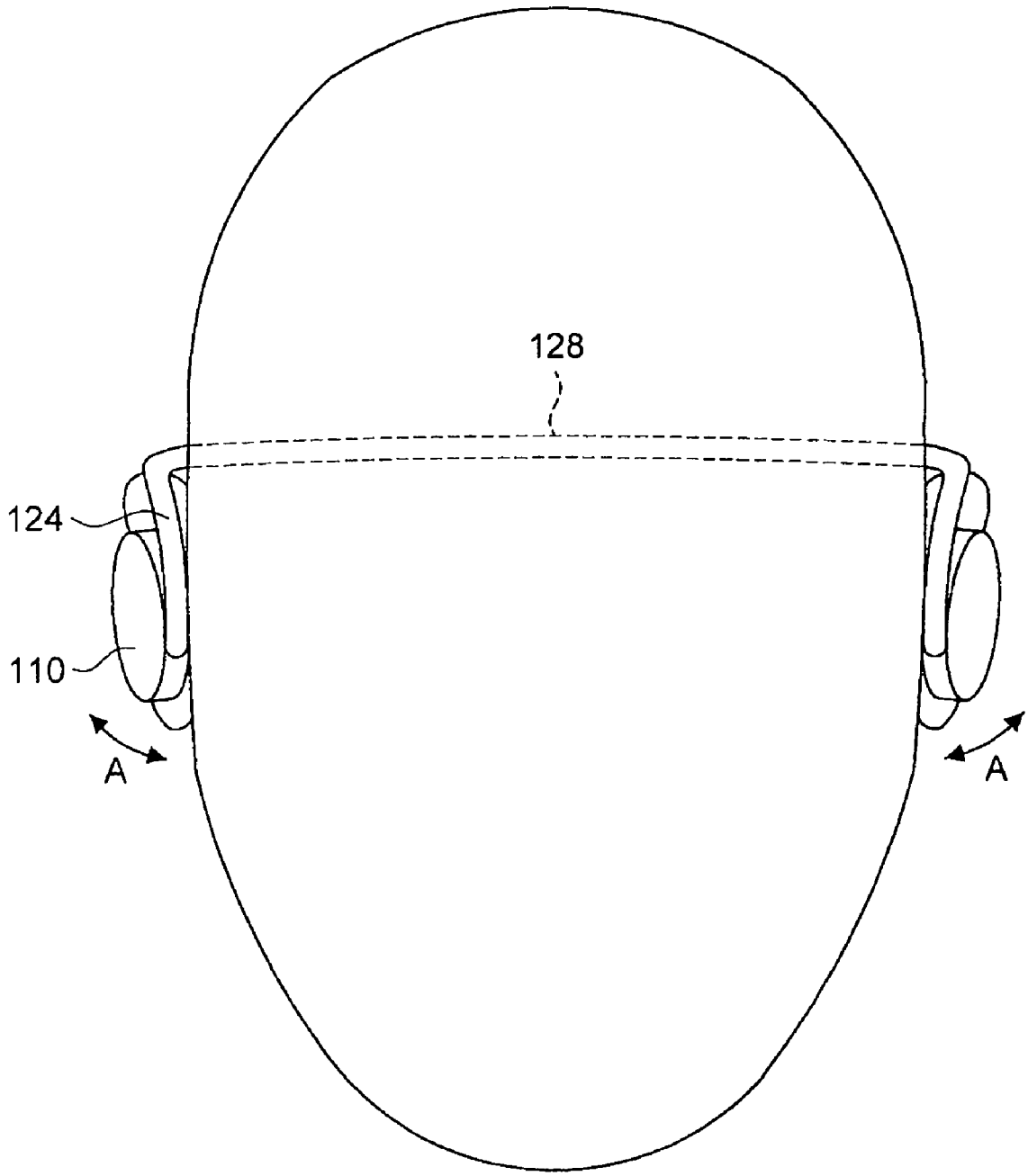
FIG. 6 is a front view showing a head wearing the headphone 100 according to the first embodiment.
Figure 7:
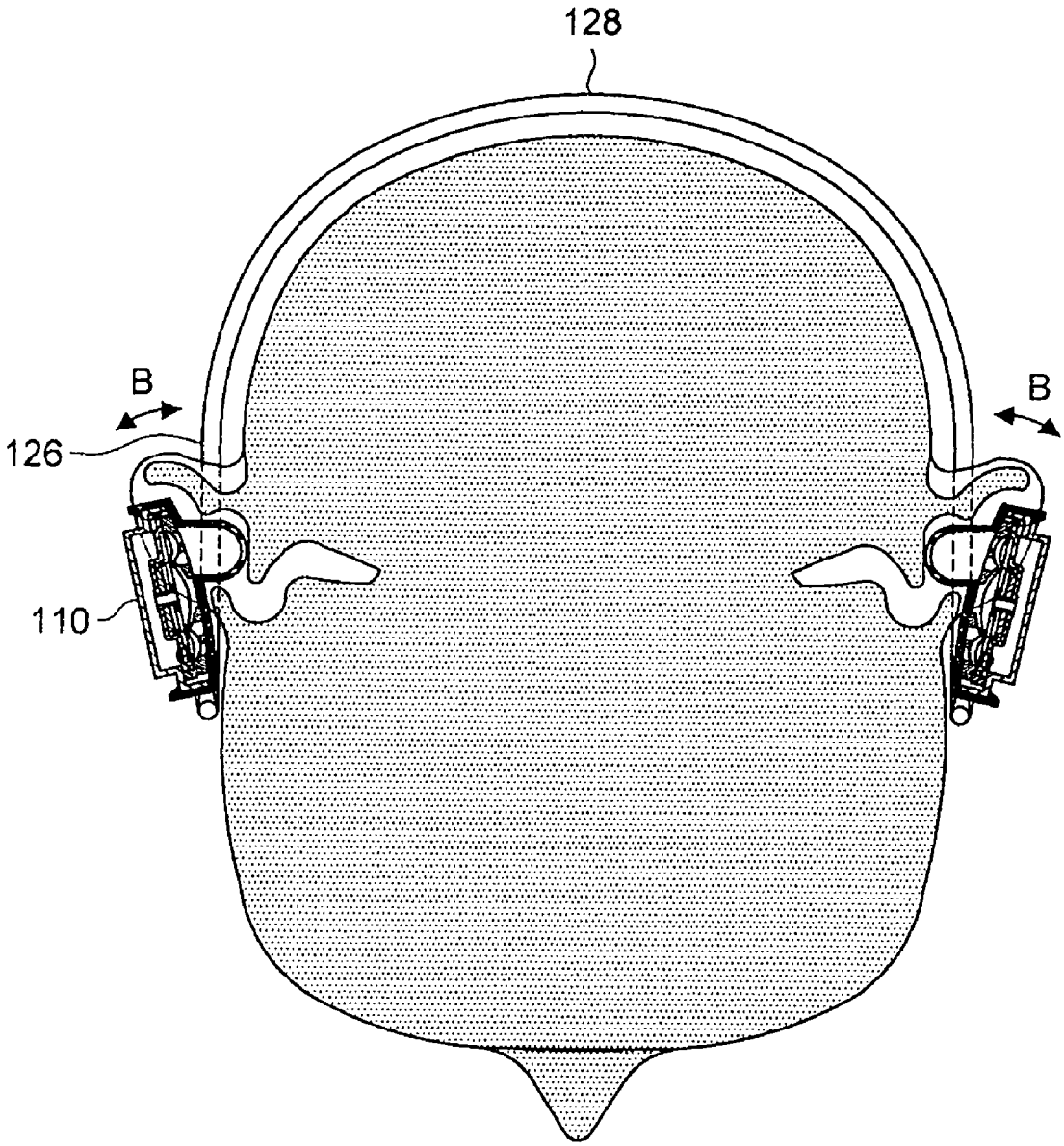
FIG. 7 is a cross sectional view showing a head wearing the headphone 100 according to the first embodiment.

Next, the neckband 120 according to the present embodiment will be explained with reference to FIG. 1 to FIG. 7. FIG. 5 is a side view showing the headphone 100 according to the first embodiment when worn on the head. FIG. 6 is a front view showing the head wearing the headphone 100 according to the first embodiment. FIG. 7 is a cross sectional view showing the head wearing the headphone 100 according to the first embodiment.

When the headphone 100 is worn, the neckband 120 is placed so that it passes around the back of the head. The neckband 120 is a ring form with a partially cut-out section or is generally C shaped. The neckband 120 includes curved portions with a further bow-shaped curve to the inner side in the vicinity of both ends 122*a* and 122*b*. The inner sides of the end 122*a* and the end 122*b* are connected to the respective housings 110.

When no external pressure is applied to the neckband 120, such as when it is not being worn, namely, when it is not in position on the head, the neckband 120 is generally coplanar with the flat surfaces of the housings 110. As shown in FIG. 2, the neckband 120 is placed on the head in a deformed condition where the housings 110 connected to the neckband 120 face each other. FIG. 5 to FIG. 7 show the headphone 100 in position on the head. As shown in FIG. 2, when the neckband is flexed due to external pressure, it has an elastic force that works in a direction to return it to the coplanar arrangement when it is not worn.

The neckband 120 is formed of an elastic material such as a synthetic resin, for example polybutyleneterephtalate (PBT) resin, polypropylene (PP) or the like. The neckband 120 is formed, for example, as a single-piece structure manufactured by injection molding using a die assembly.

The cross section of the neckband 120 may be, for example, an approximate circular shape or an elliptical shape, or may be a flat band shape. If the cross section of the neckband 120 is a circular shape, it can have a diameter of 4 mm, for example. The cross section of the neckband 120 may have a constant cross-sectional area from one end to the other end, or the shape may be partially changed, with sections having a different cross-sectional area. The neckband 120 may, for example, contain a built-in cord to transmit the replay signal. In order to contain the cord, a groove (not shown in the figures) may be formed along the full length of the neckband 120.

The neckband 120 as described above is formed as a single-piece structure, but it can be divided into the following major sections: sections 124 that are hooked over the auricle (hereinafter referred to as "auricle hooking over sections 124"), sections 126 that pass along the temporal region of the head (hereinafter referred to as "head temporal region sections 126"), and a section 128 that passes around the occipital region of the head (hereinafter referred to as the "head occipital region section 128"). Each of the components of the neckband 120 will be explained below.

The auricle hooking over sections 124 are the sections that curve to the inner side in the vicinity of the end 122*a* and the end 122*b* of the neckband 120, and have, for example, a bow shape with a radius of approximately 40 mm. The auricle hooking over sections 124 are formed as a pair. The auricle hooking over sections 124 are connected at one end to the housings 110, and the other end is continuously connected to the head temporal region sections 126. When the headphone 100 is worn, as shown in FIG. 5 and FIG. 6, the auricle hooking over sections 124 are passed between the auricle 10 surface that faces the temporal region of the head and the temporal region of the head and are hooked over the auricle 10.

The head temporal region sections 126 are the sections provided on both sides of the headphone 100. For example, they have a straight line shape of approximately 100 mm or a curved line shape with a moderate curvature. The head temporal region sections 126 are formed as a pair. The head temporal region sections 126 are connected at one end to the auricle hooking over sections 124, and the other end is continuously connected to the head occipital region section 128. When the headphone 100 is worn, as shown in FIG. 5 to FIG. 7, the head temporal region sections 126 are positioned along the temporal regions of the head so that they are in close proximity to the temporal regions of the head.

The head occipital region section 128 is a section provided on one side of the headphone 100, and is, for example, a bow shape of a generally half-arc shape with a radius of approximately 60 mm. The head occipital region section 128 has a larger curvature than the auricle hooking over sections 124. Each end of the head occipital region section 128 is continuously connected to each of the head temporal region sections 126. When the headphone 100 is worn, as shown in FIG. 5 to FIG. 7, the head occipital region section 128 is positioned along the occipital region of the head, so that it is in close proximity to the occipital region of the head.

The headphone 100 may further include coupling members 130*a* and 130*b*. The coupling members 130*a* and 130*b* are provided on each of the ends 122*a* and 122*b* of the neckband 120. The coupling members 130*a* and 130*b* are coupled to each other.

When it is not being worn, the headphone 100 has a shape as shown in FIG. 1, with the ends 122*a* and 122*b* of the neckband 120 in proximity to each other. By providing a coupling member 130*a* and a coupling member 130*b* respectively on each of the sections where the ends 122*a* and 122*b* of the neckband 120 come into contact with each other, the ends 122*a* and 122*b* can be connected, allowing the neckband 120 to be generally coplanar with the housing 110 during storage.

Figure 8:
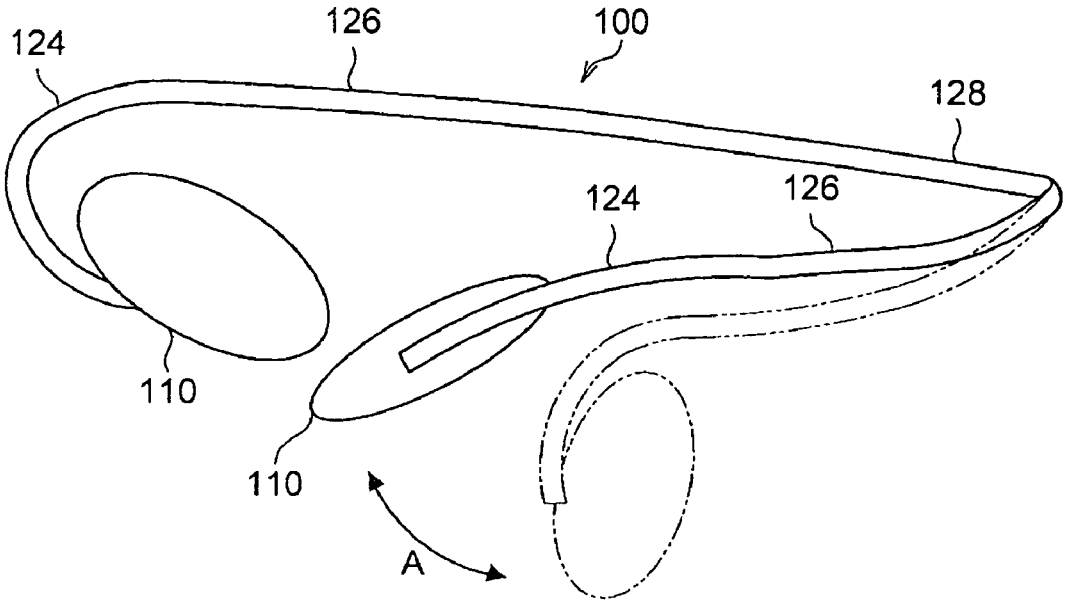
FIG. 8 is a perspective view showing the tilt angle movement of the headphone 100 according to the first embodiment.
Figure 9:
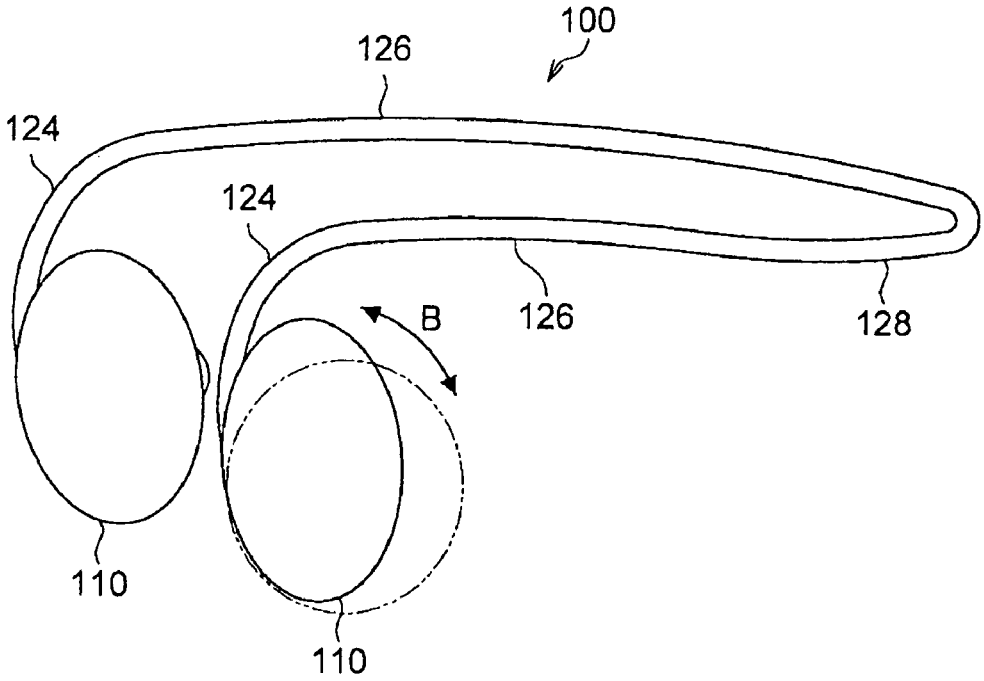
FIG. 9 is a perspective view showing the twist angle movement of the headphone 100 according to the first embodiment.

Next, the movement of the headphone 100 according to the present embodiment will be explained. FIG. 8 is a perspective view showing the tilt angle movement of the headphone 100 according to the present embodiment. FIG. 9 is a perspective view showing the twist angle movement of the headphone 100 according to the present embodiment.

First, the headphone 100 will be explained when it is not being worn. As described above, the neckband 120 is generally coplanar with the flat surface of the housing 110, in the shape shown in FIG. 1. Further, if the coupling members 130*a* and 130*b* are formed on the ends 122*a* and 122*b* of the neckband 120, the coupling members 130*a* and 130*b* are coupled with each other.

Next, when the headphone 100 is worn on the head, the housing 110 is positioned so that one surface of the housing 110 on the side on which the playback sound is output comes into contact with the outer side of the auricle 10. With the application of external pressure, the neckband 120 is flexed so that it opens outwards and so that the housings 110 face each other. The neckband 120 is positioned so that it passes around the occipital region of the head in its flexed position.

As the neckband 120 has elasticity in a direction that causes it to return to a generally coplanar arrangement when it is not worn, when external pressure is applied to maintain the shape of the headphone 100 when it is being worn, an energizing force urges the neckband 120 and the housing 110 to return in an inward direction.

Next, the neckband 120 will be explained in detail when it is worn. First, the headphone 100, as shown in FIG. 6 and FIG. 8, has an elastic force that causes movement in a rotational direction where the angle axis runs in an anteroposterior direction in relation to the head (hereinafter referred to as the tilt angle direction A). Also, the headphone 100, as shown in FIG. 9, has an elastic force that causes movement in a rotational direction where the angle axis runs in a vertical direction in relation to the head (hereinafter referred to as the twist angle direction B).

The tilt angle direction A elastic force is mainly obtained by the energizing force that acts to cause the neckband 120, in particular the auricle hooking over sections 124 and the head temporal region sections 126, to return to a generally coplanar arrangement. There are individual differences in the incline of the temporal region and in the tilt of the auricle 10 in a vertical direction in relation to the head. For example, in some cases the jaw is narrower than the head, while in other cases the jaw is wider than the head. As the headphone 100 has the elastic force for the tilt angle direction A, the angle for the placement of the housing 110 can be adjusted in accordance with the incline of the temporal region of the head and of the auricle 10.

Also, the twist angle direction B is mainly obtained by the torsion of the auricle hooking over sections 124 of the neckband 120. There are individual differences in the incline of the temporal region and in the tilt of the auricle 10 in an anteroposterior direction in relation to the head. For example, in some cases the surface of the auricle 10 that faces the temporal region of the head is separate from the temporal region of the head (so-called "prominent ears"), while in other cases the surface of the auricle 10 facing the temporal region of the head is closely proximate to the temporal region (so-called "flat ears"). As the headphone 100 has the elastic force for the twist angle direction B, the angle for the placement of the housing 110 can be adjusted in accordance with the incline of the temporal region of the head and of the auricle 10.

As described above, the headphone 100 has an elastic force in a direction that causes the neckband 120 to return to a coplanar arrangement and has a tilt angle direction A and twist angle direction B elastic force, allowing appropriate contact with the head and the ear. Also, due to the above elastic forces, the headphone 100 is applied to the ear with an appropriate pressure. The headphone 100, therefore, is not easily dislodged by movement by the wearer, and a comfortable fit can be achieved.

With the headphone 100 according to the above-described embodiment, the flat surface of the housing 110 is generally coplanar with the neckband 120. Therefore, the width of the whole of the headphone 100 is minimized, and does not take up space when the headphone 100 is not being worn, such as when it is being carried and so on. For that reason, the headphone 100 can be conveniently carried, and display space and storage space can be minimized at the point of sale.

Also, for example, in storage tests at high temperatures (40 degrees centigrade and the like), as the headphone 100 has a shape that is generally coplanar during storage, it can demonstrate high durability in comparison with neckbands in the past having a three dimensional shape.

Also, when not being worn, the neckband 120 of the headphone 100 is generally coplanar, and the die assembly to form the neckband 120 can therefore be manufactured more easily in comparison to a neckband with a three dimensional form. The design of the die at the time of manufacture is also simplified.

Also, as the headphone 100 is made into a form that follows the shape of the head by flexing the neckband 120, it does not need to be constantly in a three dimensional form, allowing weight reduction when forming the neckband 120. For that reason, when the headphone 100 is worn, the dead weight of the neckband 120 does not cause the neckband 120 to fall in a downwards direction on the head, and the housing 110 can be positioned in a balanced manner on the head. It is therefore not necessary to separately attach a section on the housing 110 to hook onto the ear, allowing a simple structure for the headphone 100.

The headphone 100 also have an elastic force in a direction that causes the neckband 120 to return to a coplanar arrangement, and has an elastic force for the tilt angle direction A and the twist angle direction B, allowing appropriate contact with the head and the ears. Also, due to the above elastic forces, the headphone 100 is applied to the ear with an appropriate pressure. The headphone 100, therefore, does not easily move out of place due to movement by the wearer, and a comfortable fit can be achieved.

It should be understood by those skilled in the art that various modifications, combinations, sub-combinations and alterations may occur depending on design requirements and other factors insofar as they are within the scope of the appended claims or the equivalents thereof.

For example, in the present embodiment described above, the cable 140 connected to the replay device is connected to the body portion 112 of the housing 110, but the present invention is not limited to this example. For example, the cable 140 may be connected to the headphone 100 using the head temporal region sections 126 of the neckband 120. According to the present structure, the person wearing the headphone 100 is not bothered by the cable 140 touching the side of the face, and the headphone 100 can be worn without concern for the cable 140.

What is claimed is:

1. A headphone comprising:

a housing that includes a speaker unit and that has a generally flat surface that comes into contact with an outward facing surface of an auricle of an ear;

a neckband that is connected to the housing; and at least two coupling members, at least one of the coupling members being positioned at one of two sections of the neckband where two ends of the neckband come into contact with each other, and at least one other of the coupling members being positioned at the other of the two sections, such that the at least one coupling member and the at least one other coupling member can be coupled to each other to allow the neckband to be generally coplanar with the housing during storage of the headphone, wherein the neckband has a ring form with a partially cut-out section, an inner side of at least one end of the neckband being connected to the housing and the neckband and the generally flat surface of the housing are generally coplanar, and have an elastic force in a direction that causes the neckband and the generally flat surface of the housing to return to the coplanar arrangement.

2. The headphone according to claim 1, wherein the end of the neckband is formed in a bow shape, and a curvature of the end is smaller than a curvature of the other sections of the neckband.

3. The headphone according to claim 1, wherein the neckband is formed of an elastic material.

4. The headphone according to claim 3, wherein when the headphone is worn on a head, the housing rotates due to flexure of the neckband.

5. The headphone according to claim 4, wherein the rotation of the housing is centered around an axis lying in a vertical direction in relation to the head.

6. The headphone according to claim 4, wherein the rotation of the housing is centered around an axis lying in an anteroposterior direction in relation to the head.

7. The headphone according to claim 1, wherein a cable is connected to an inner side of the neckband that is in proximity to the head, the cable transmitting a playback signal that is transmitted from a replay device.

8. The headphone according to claim 1, wherein the housing includes a receiving portion that wirelessly receives a playback signal transmitted from a replay device.

9. The headphone according to claim 1, wherein a cross section of the neckband is one of generally circular and a flat plane.

10. A headphone comprising:

a housing that includes a speaker unit and that has a generally flat surface that comes into contact with an outward facing surface of an auricle of an ear;

a neckband that is connected to the housing; and at least two coupling members, at least one of the coupling members being positioned at one of two sections of the neckband where two ends of the neckband come into contact with each other, and at least one other of the coupling members being positioned at the other of the two sections, such that the at least one coupling member and the at least one other coupling member can be coupled to each other to allow the neckband to be generally coplanar with the housing during storage of the headphone, wherein the neckband has a ring form with a partially cut-out section, an inner side of at least one end of the neckband being connected to the housing, and when the headphone is not worn, the neckband is generally coplanar with the generally flat surface of the housing, and when the headphone is worn, the end of the neckband is arranged around an auricle of an ear, and a section excluding the end and having a larger curvature than the end is arranged around an occipital region of a head, and the neckband and the housing have an elastic force in a direction that causes the neckband and the housing to return to the generally coplanar arrangement.

11. The headphone according to claim 10, wherein when the headphone is worn on the head, the housing rotates due to flexure of the neckband.

* * * * *